US007814909B2

(12) United States Patent
Rylander

(10) Patent No.: US 7,814,909 B2
(45) Date of Patent: Oct. 19, 2010

(54) BREATHING MASK

(75) Inventor: Olof Rylander, Stockholm (SE)

(73) Assignee: Interspiro AB, Lidingo (SE)

( * ) Notice: Subject to any disclaimer, the term of this patent is extended or adjusted under 35 U.S.C. 154(b) by 925 days.

(21) Appl. No.: 11/402,496

(22) Filed: Apr. 12, 2006

(65) Prior Publication Data

US 2006/0225739 A1 Oct. 12, 2006

(30) Foreign Application Priority Data

Apr. 12, 2005 (SE) ..... 0500826

(51) Int. Cl.
*A62B 18/02* (2006.01)

(52) U.S. Cl. ..... 128/206.21; 128/205.25

(58) Field of Classification Search ..... 128/201.19, 128/201.23, 201.24, 204.18, 205.25, 206.12, 128/206.14, 206.21, 206.28, 206.19
See application file for complete search history.

(56) References Cited

U.S. PATENT DOCUMENTS

| | | | | |
|---|---|---|---|---|
| 4,276,877 | A | 7/1981 | Gdulla | |
| 4,378,011 | A * | 3/1983 | Warncke et al. | 128/204.26 |
| 5,297,544 | A * | 3/1994 | May et al. | 128/202.22 |
| 5,372,130 | A * | 12/1994 | Stern et al. | 128/205.25 |
| 5,449,624 | A * | 9/1995 | Kildal-Brandt et al. | 436/500 |
| 5,572,990 | A * | 11/1996 | Berlin | 128/201.19 |
| 6,016,802 | A * | 1/2000 | Jackson | 128/205.25 |
| 2003/0127093 | A1 * | 7/2003 | Maniscalco | 128/201.23 |
| 2003/0168060 | A1 | 9/2003 | Richardson et al. | |

FOREIGN PATENT DOCUMENTS

| | | |
|---|---|---|
| EP | 0 686 408 A2 | 12/1995 |
| WO | WO-96/07452 A1 | 3/1996 |

* cited by examiner

*Primary Examiner*—Justine R Yu
*Assistant Examiner*—Colin Stuart
(74) *Attorney, Agent, or Firm*—Marshall, Gerstein & Borun LLP

(57) ABSTRACT

A full breathing mask including an inner face mask and an outer face mask. The outer face mask includes a basin-shaped intermediate wall which extends from the inside of the outer face mask and which has a free end, a con-cave side, which is intended to embrace and lie in abutment with the wearer's chin part, and a convex side. At least substantially the entire perimeter of the inner face mask is adapted to lie against the wearer's face.

11 Claims, 5 Drawing Sheets

Prior Art

BREATHING MASK

CROSS-REFERENCE TO RELATED APPLICATIONS

This application is based on and claims priority to Swedish Patent Application No. SE 0500826-3, filed on Apr. 12, 2005, the contents of which are hereby expressly incorporated herein by reference.

FIELD OF THE DISCLOSURE

The present disclosure relates to a full breathing mask that has an inner face mask and an outer face mask, wherein the outer face mask includes a hood-shaped intermediate wall which extends outward from the inside of the outer face mask and which has a free end. The intermediate wall includes a concave and a convex side. The disclosure also relates to a method of reducing the amount of carbon dioxide that is inhaled when using breathing gas through the medium of the breathing mask.

BACKGROUND OF THE DISCLOSURE

Full breathing masks that include an inner face mask and an outer face mask are known and have been used for many years in environments where the inhalation of an ambient atmosphere is unsuitable or impossible, for instance when the wearer is situated under water, when the partial pressure of oxygen is insufficient, for instance at high altitudes, and fails to administer the amount of oxygen required, or the atmosphere contains or is feared to contain poisonous or harmful substances, such as carbon monoxide for instance.

Full breathing masks of this kind comprise an outer face mask which includes a hood-like intermediate wall which extends out from the inside of the mask and which has a free end. The intermediate wall has a concave or a convex side, where the concave side is intended to embrace and lie against the wearer's chin. The perimeter of the inner face mask abuts the convex side of the intermediate wall and the wearer's face outwardly thereof. The inner face mask and the intermediate wall enclose or surround the wearer's mouth and nose. The inner face mask which partially abuts the intermediate wall and partially the wearer's face defines a first chamber with the wearer's face, i.e., his or her mouth and nose. The outer face mask defines a second chamber together with the wearer's face and the outside of the inner face mask.

Such a full breathing mask is worn on the wearer's face when in use, wherewith the outer face mask and the inner face mask are held pressed against the wearer's face with the aid of straps on the outer face mask. The breathing mask is connected by a hose or the like to a source of breathing gas, typically a container in which the gas is contained under high pressure.

The gas taken from the pressurized container is reduced by a first pressure regulator to a pressure on the order of 7 bars and prior to being delivered to the breathing mask is reduced typically to a pressure in the order of 2.5 millibars or 25 mm water column by a second pressure regulator.

The gas from the second pressure regulator is delivered first to the outer face mask and then to the inner face mask through openings therein. The openings in the inner face mask include check valves for preventing exhalation gas from flowing to the outer face mask.

The gas present in the inner face mask is inhaled by the wearer who, by exhalation, then delivers the exhalation gas to the inner face mask, this gas containing a high concentration of carbon dioxide. The exhaled gas is forced through a passageway to the ambient surroundings, via the inner face mask. The passageway includes a check valve which prevents the ambient atmosphere from entering the inner face mask.

When a fresh breath is taken, the exhalation gas that is present in the airways of the wearer and in the inner face mask will be inhaled first and thereafter fresh breathing gas is taken from the outer face mask. The amount of gas which subsequent to exhalation is inhaled is designated dead space. The volume defined by the breathing path of the wearer is designated anatomic (inner) dead space whereas the volume of re-inhaled gas being outside the breathing path is designated dynamic outer dead space.

One drawback with known breathing masks is that the gas of exhalation is pressed between the intermediate wall and the inner face mask and out into the outer face mask. The fresh breathing gas present in the outer face mask then becomes contaminated with carbon dioxide from the exhaled gas. Thus, the dynamic outer dead space does not solely consist of the volume of gas present in the inner face mask, but also in the volume of gas present in the outer face mask.

FIGS. 1 and 2 illustrate one known so-called full breathing mask comprising an outer face mask 1 and an inner face mask 11. The full breathing mask includes a wall 21 which is situated distal from a wearer when the mask is donned and which is common to both the outer face mask 1 and the inner face mask 11. The wall 21 includes a speech membrane 22.

The outer delimiting part of the outer face mask 1 extends from the common wall 21 towards the wearer and merges with an essentially circular or oval perimeter 3, 4, which is intended to abut the wearer's face and to enclose a facial region that includes the eyes, nose, mouth and chin of the wearer. The upper part of the perimeter is referenced 3 and the lower part thereof is referenced 4. The outer limitation of the outer face mask 1 also includes a visor 8 and, although not shown, an opening that is provided with a breathing valve for the supply of breathing gas from a gas source, for instance from a container carried by the mask wearer. The breathing mask is held in place by straps 2 the ends of which are fastened in the outer face mask of the full breathing mask as shown in FIG. 1.

The upper part of the perimeter 3 of the outer face mask 1 has a generally concave face-abutment surface which merges with a part shown at the bottom of the figure, this part forming an intermediate wall 4 that extends outward from the inside of the outer face mask 1. The intermediate wall 4 extends from the inside of the outer face mask 1 and in over the wearer's chin and terminates in a free edge 5 below the wearer's mouth. The intermediate wall 4 is bowl-shaped and embraces the chin of the wearer and therewith has a concave abutment surface 7 which faces towards the wearer's chin and has on the other side a convex surface 6 which is turned away from the wearer's face.

The inner face mask 11 spreads from the common wall 21 toward the wearer's face wherewith the perimeter 12, 13 of the wall is in direct abutment or indirect abutment with the wearer's face. An upper perimeter part 12 directly abuts the wearer's face above the upper edge 5 of the intermediate wall 4 of the outer face mask 1, and then passes to a lower perimeter part 13 which lies against the convex surface 6 of the intermediate wall 4. The perimeter part 12 of the inner face mask 11 has a convex abutment surface.

The wall 21 common to both the outer face mask 1 and the inner face mask 11 includes an opening 14 which connects the interior of the inner face mask 11 with the surroundings. The opening 14 is provided with a check valve 15 which allows gas to pass from the interior of the inner face mask 11 to the surroundings, while preventing the ingress of ambient atmosphere into the inner face mask 11.

The inner face mask 11 has at least one opening 16 which connects the inner face mask 11 with the outer face mask 1. The opening 16 is provided with a check valve 17 which allows gas to pass from the outer face mask 1 to the inner face mask 11 but prevents the flow of gas in the opposite direction.

When the breathing mask is in use, breathing gas that has a pressure of about 25 mm water column is delivered to the wearer as he or she inhales, wherewith gas flows into the outer face mask 1 and then through the opening 16 and into the inner face mask 11 and from there into the airways of the wearer. As the wearer then breaths out, the exhalation gas is pressed into the inner face mask 11 and from there through the outlet opening 14 to the surrounding atmosphere. This exhalation gas contains carbon dioxide produced in the wearer's lungs in an amount on the order of 5%. With the next breath taken by the wearer, the exhalation gas present in the inner face mask 11 will be inhaled before fresh breathing gas reaches the upper airways of the wearer. For this reason breathing masks are produced with an inner face mask that has the smallest possible volume in practice. This volume is designated dynamic outer dead space.

It has been found that ideal flow of exhalation gas is not achieved with such known breathing masks. It has also been found that exhalation gas having an elevated carbon dioxide content leaks from the inner face mask 11 to the outer face mask 1 during exhalation. This leakage probably takes place in the region of the intermediate wall 4 against which the lower perimeter 13 of the inner face mask 11 abuts. Since the inner face mask 11 has a higher pressure than 25 mm water column during the exhalation phase, the pressure in the outer face mask 1 is lower than the pressure in the inner face mask 11. The force with which the lower perimeter 13 of the inner face mask 11 lies against the intermediate wall 4 is not sufficient to prevent exhalation gas from flowing between the intermediate wall 4 and the lower perimeter of the inner face mask 11. As a result, the clean breathing gas in the outer face mask 1 becomes contaminated with carbon dioxide. This leakage also results in the volume of the outer face mask 1 being contaminated with carbon dioxide. Consequently it is not only the carbon-dioxide-containing gas from the upper airways and the inner face mask 11 that reaches the lungs of the wearer before fresh breathing gas is received, but also the volume of carbon-dioxide-containing gas present in the outer face mask 1 that is inhaled prior to the delivery of fresh breathing gas. As a result of this larger amount of carbon dioxide that is first inhaled, the rated minute ventilation will be greater and more fresh breathing gas will be consumed. This drawback and others not explicitly described have been overcome with a full breathing mask according to the present disclosure.

SUMMARY OF THE DISCLOSURE

One aspect of the present disclosure is to provide a method of reducing the amount of carbon dioxide that is inhaled when inhaling breathing gas or air through a breathing mask.

Another aspect is to reduce the rated minute ventilation for a person using a breathing mask constructed in accordance with the present disclosure.

Still another aspect is to create a full breathing mask which includes an outer face mask and an inner face mask and which has a substantially smaller dynamic outer dead space.

The disclosure relates to a method of reducing the amount of carbon dioxide inhaled when breathing with a full breathing mask which is worn on the face of the wearer and which includes an inner face mask and an outer face mask. Breathing gas or air is first delivered to the outer face mask and thereafter to the inner face mask. Exhaled gas is caused to flow through the inner face mask prior to being released to the surroundings. The mask may include a filter intended for cleansing ambient air and through which the ambient air is filtered prior to entering the outer face mask, or means for delivering to the outer face mask clean breathing gas as demanded, for instance air or a mixture of at least 20% oxygen and the remainder nitrogen or hydrogen taken from a storage container.

The significant feature of this method resides in the reduction of the volume of the dynamic outer dead space and thereby also the reduction of the amount of necessary breathing gas. This reduction in the volume of the dynamic outer dead space is achieved by preventing exhalation gas from leaking from the inner face mask to the outer face mask during an exhalation stage of the breathing cycle, by causing the entire perimeter of the inner face mask to lie in abutment with the face of the wearer.

In one form of the disclosure, the perimeter of the outer face mask is caused to lie against the face of the wearer and a part of an intermediate wall that extends out from the inside of the outer face mask and having an opposite free end is caused to lie in abutment with the inner face mask. Especially the part of the intermediate wall that starts out from the free end is caused to lie in abutment with the inner face mask.

In this case, the inner face mask includes a rearwardly curved or bent flap which together with the inner face mask forms a channel in which the free end of the intermediate wall is inserted. In a further development of this form, when the full breathing mask is donned, the flap is caused to exert pressure on one side of the intermediate wall facing towards the chin of the wearer.

The present disclosure relates in particular to a full breathing mask in which the volume of the dynamic outer dead space is smaller than that of prior art full breathing masks, wherewith the amount of earlier utilized breathing gas is significantly depleted.

The full breathing mask includes an inner face mask and an outer face mask. The outer face mask includes an intermediate wall in the shape of a skull cap, which extends from the inside of said face mask and which has a free end, a concave side, which is intended to embrace and lie against the chin of the wearer, and a convex side. Therefore, when the breathing mask is donned the entire perimeter of the inner face mask will lie against the face of the wearer.

According to one aspect, the free end of the intermediate wall is spaced from the wearer's face. According to another aspect, the inner face mask includes a flap which forms a channel together with the inner face mask. The channel will preferably have a U-shaped cross-section. The free end of the intermediate wall is inserted into the channel. It is particularly preferred that the flap on the inner face mask will be pressed or biased into abutment with the concave side of the intermediate wall. The flap forms the U-shaped channel together with the inner face mask and may be an integral part or a connected part or a continuous part of the inner face mask or may also be a separate part that is fastened to the inner face mask.

DETAILED DESCRIPTION OF THE DISCLOSURE

Figure 1:
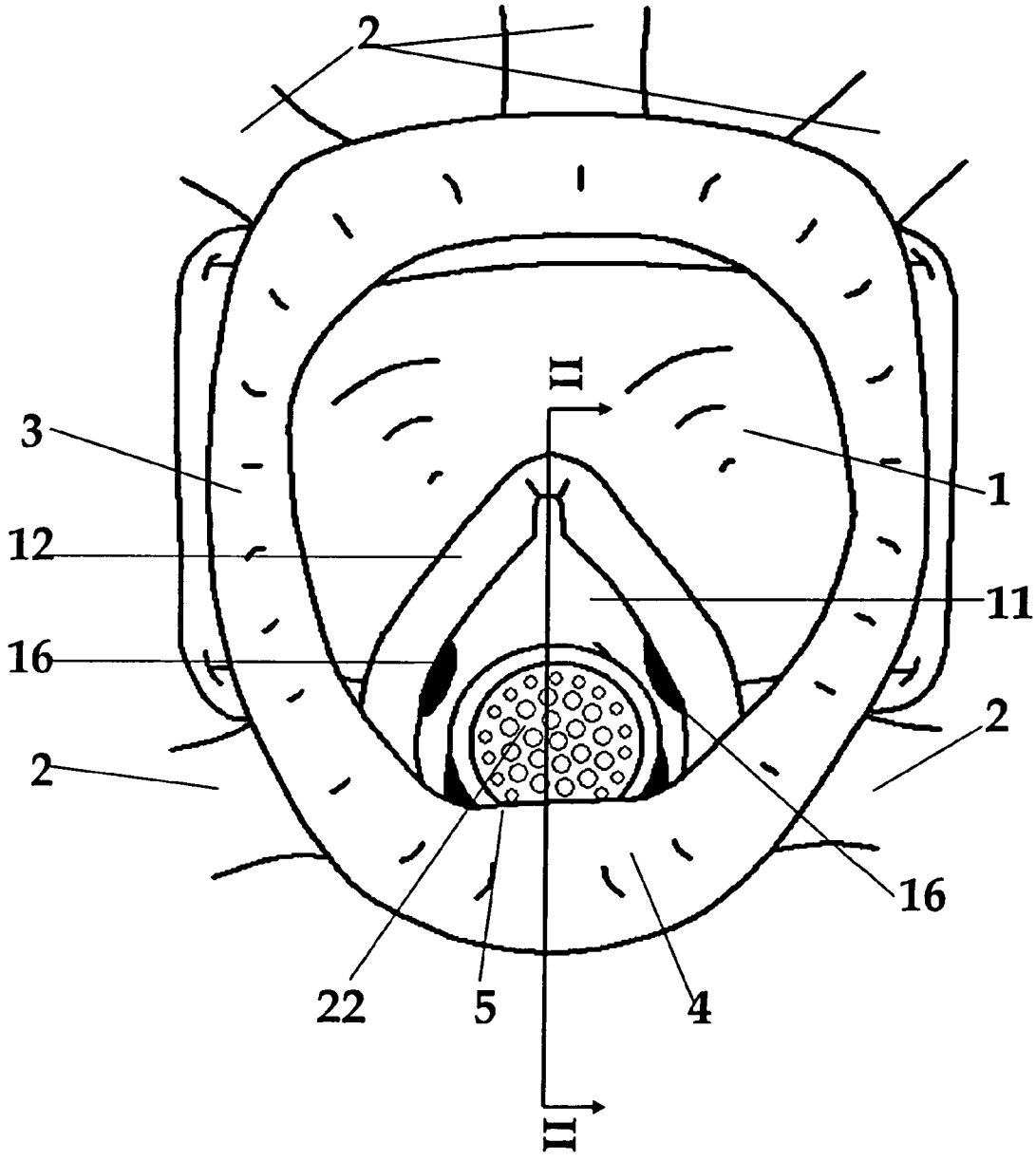
FIG. 1 illustrates a known breathing mask arrangement, as seen from a wearer.
Figure 2:
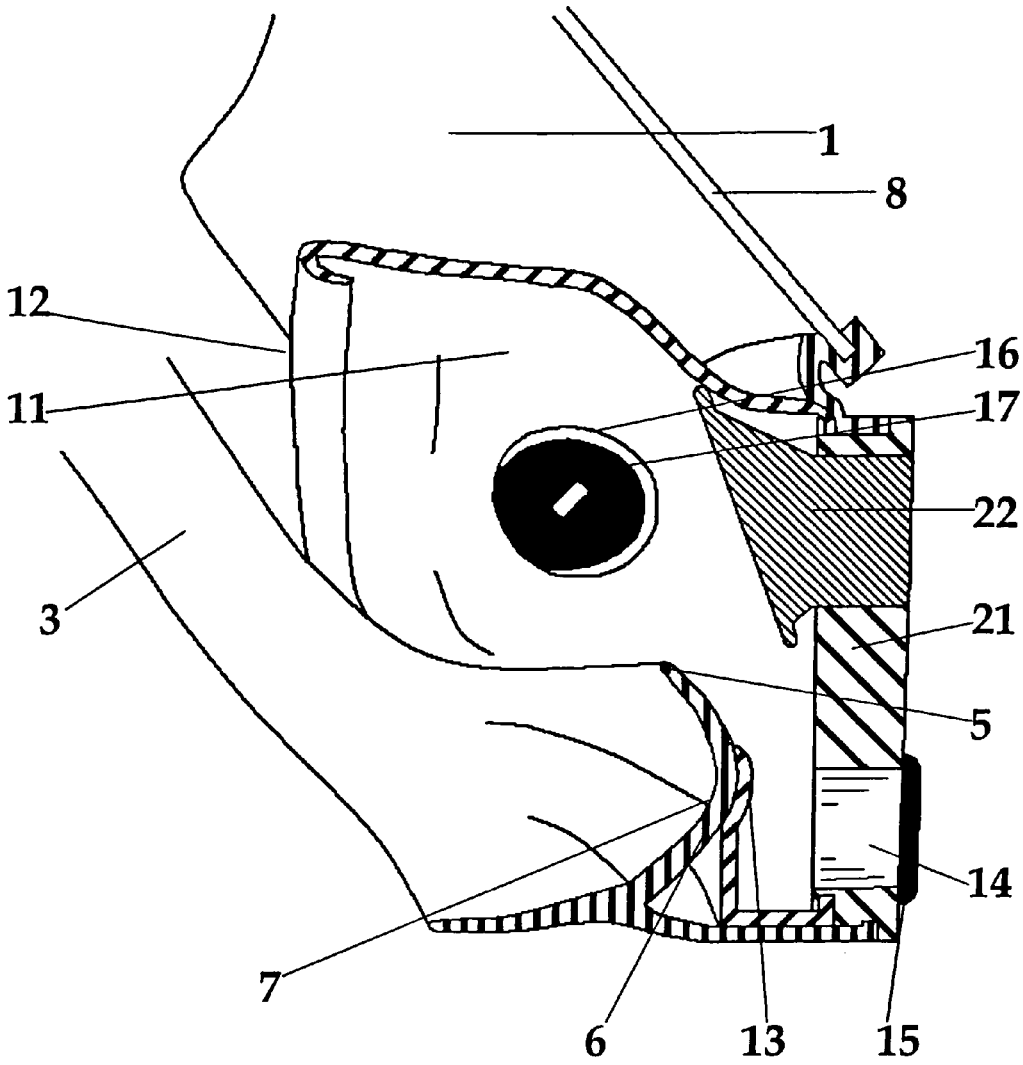
Fig. 2 Prior Art
FIG. 2 is a partial cross-sectional view of the known breathing mask arrangement taken through the line II-II of FIG. 1.
Figure 3:
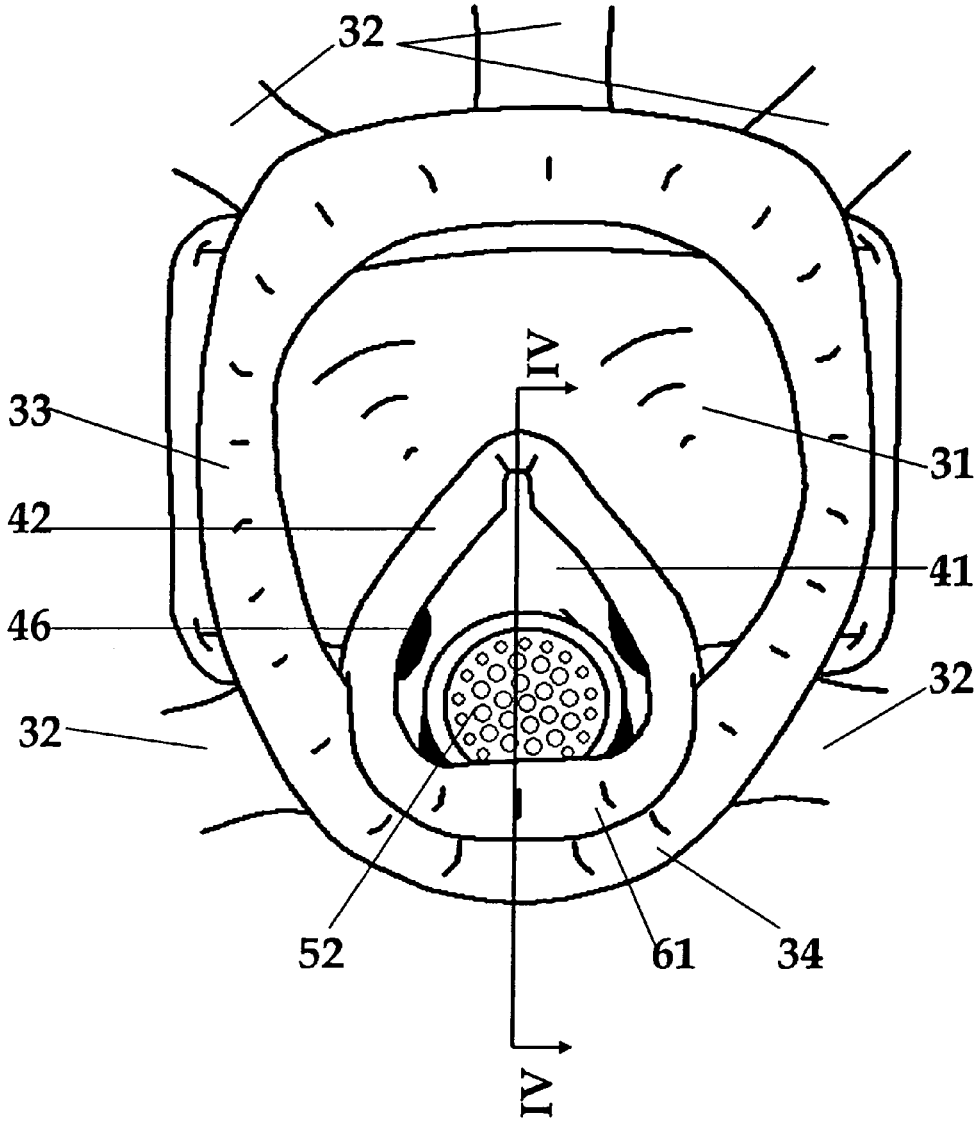
FIG. 3 illustrates a full breathing mask according to the present disclosure, as seen from a wearer.
Figure 4:
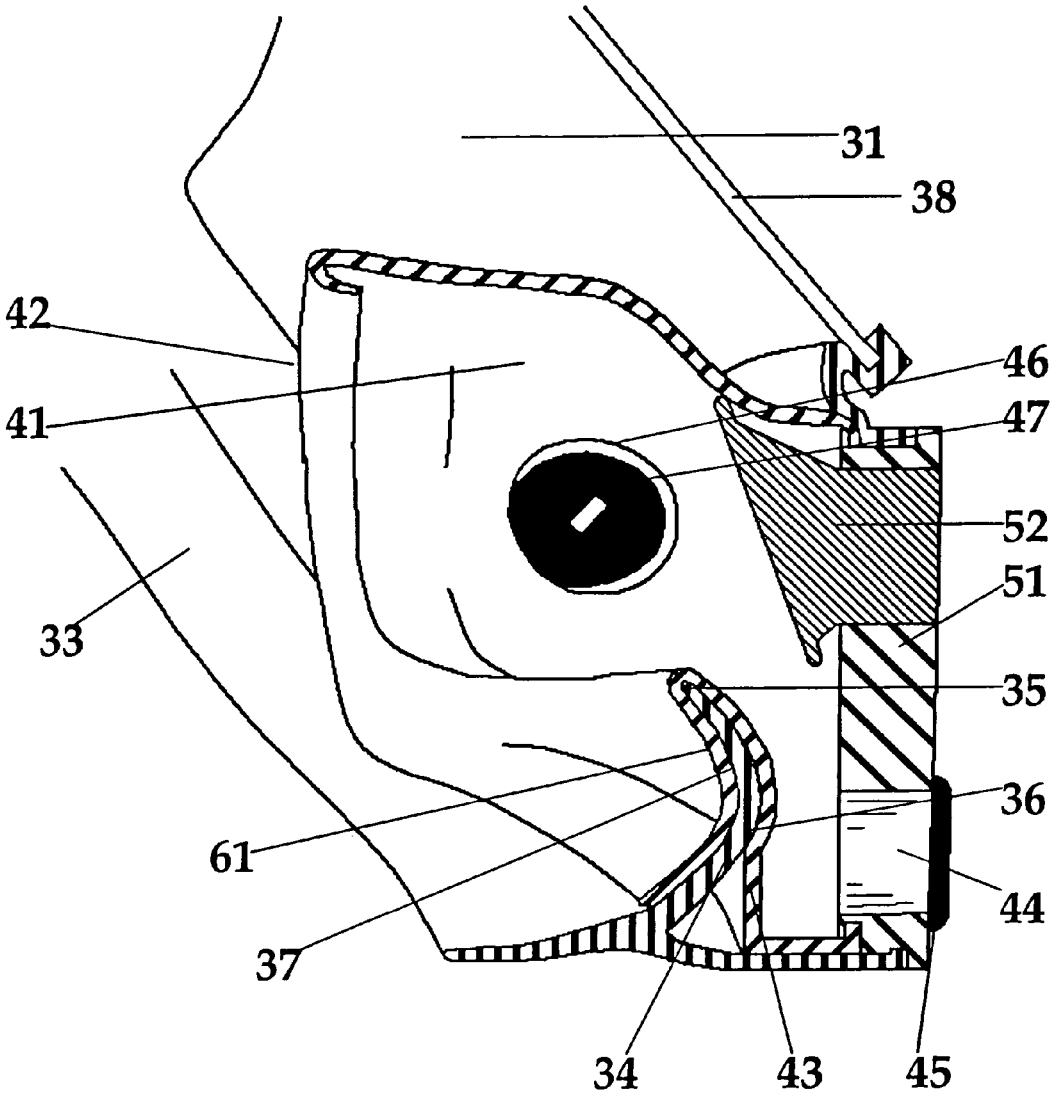
FIG. 4 is a partial cross-sectional view of the full breathing mask of the present disclosure taken through the line IV-IV of FIG. 3.

FIGS. 3 and 4 illustrate a full breathing mask comprising an outer face mask 31 and an inner face mask 41. The breathing mask includes a wall 51 which when the breathing mask is donned extends away from the wearer and which is common to both the outer face mask 31 and the inner face mask 41. The wall 51 includes a speech membrane 52.

The outer limitation of the outer face mask 31 spreads from the common wall 51 towards the wearer and merges with a generally circular or oval perimeter 33, 34 which is intended for abutment with the wearer's face and encloses an area of the wearer's face that includes eyes, nose, mouth and chin. The upper part of the perimeter is referenced 33 and the lower part is referenced 34. The outer limitation of the outer face mask 31 also includes a visor 38 and an opening (not shown) which is provided with a breathing valve for the delivery of breathing gas from a gas storage means, for instance from a wearer-carried container. The full breathing mask is held in place by straps 32, the ends of which are shown fastened in the outer face mask 31 in FIG. 3.

The upper part of the perimeter 33 of the outer face mask 31 has a generally concave face-abutment surface which merges with a part shown at the bottom of the figure, this part forming an intermediate wall 34 that extends outward from the inside of the outer face mask 31. The intermediate wall 34 extends from the inside of the outer face mask 31 down over the wearer's chin and terminates in a free edge 35 downwardly of the wearer's mouth. The intermediate wall 34 has a bowl-like shape for enclosure of the chin part of the wearer's face and therewith a concave abutment surface 37 turned toward the wearer's chin and on its other side a convex surface 36 which is turned away from the wearer's face.

The inner face mask 41 spreads from the common wall 51 toward the wearer's face, wherewith an upper part 42 of its perimeter is in direct abutment with the wearer's face. A lower part 43 of the inner face mask 41 abuts with the convex surface 36 of the intermediate wall 34. This lower part 43 of the inner face mask extends right up to the free end edge 35 of the intermediate wall 34 and passes into a rearwardly bent flap 61 which, together with the lower part 43, defines a U-shaped or V-shaped channel into which the intermediate wall 34 is inserted. The free end 35 of the intermediate wall 34 is preferably inserted to the bottom of the channel, although it may also be spaced from the bottom. The concave surface 37 of the intermediate wall 34 lies against the flap 61 and, when the breathing mask is donned, the intermediate wall 34 presses the flap 61 against the face of the wearer. The flap 61 and the upper part 42 of the perimeter of the inner face mask 41 lie in direct abutment with the wearer's face. The distance between the flap 61 and the lower part 43 of the inner face mask 41 may be slightly less than the thickness of the intermediate wall 34, so that the flap 61 and the lower part 43 of the inner face mask 41 will exert a pressure on the intermediate wall 34. The inner face mask 41 and the flap 61 are comprised generally of a resilient material, which may be a polymeric material. The flap 61 may be affixed to the inner face mask 41 or may be an integral part thereof. In one form, the flap 61 includes a decreasing cross-section in a direction away from the bottom of the channel.

The wall 51 common to both the outer face mask 31 and the inner face mask 41 includes an opening 44 which connects the interior of the inner face mask 41 with the surroundings. The opening 44 is provided with a check valve 45 which allows gas to pass from the interior of the inner face mask 41 to the surroundings while preventing penetration of the surrounding atmosphere into the inner face mask 41.

The inner face mask 41 includes at least one opening 46 which connects the inner face mask 41 with the outer face mask 31. The opening 46 is provided with a check valve 47 which allows gas to pass from the outer face mask 31 to the inner face mask 41 while preventing the flow of gas in the opposite direction.

According to a further form, the inner face mask 41 begins from the common wall 51 and the whole of its perimeter lies against the wearer's face. In this case, the intermediate wall 34 has a short distance to its edge 35 so that the perimeter of the inner face mask 41 will embrace the nose and mouth parts of the wearer without contacting the intermediate wall 34. In such a case, the intermediate wall 34 solely has a supportive function.

Figure 5:
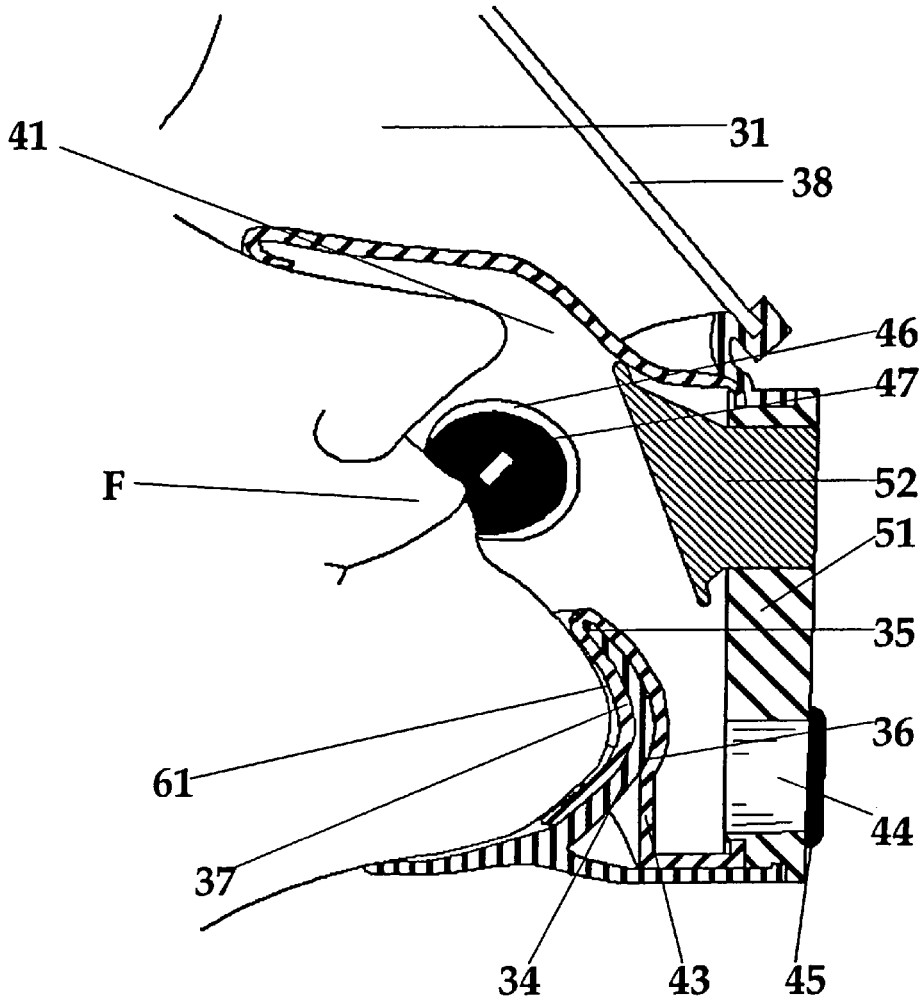
FIG. 5 is a partial cross-sectional view of the full breathing mask of the present disclosure, similar to that shown in FIG. 4, but also showing a contour of a wearer's face.

FIG. 5 shows a contour of a face F. The chin part of the face lies against the flap 61 of the inner face mask 41. In this case, the flap 61 has a length such as to cover substantially the entire concave side 37 of the intermediate wall. When the full breathing mask is placed on the wearer's head, the straps 32 are tightened (see FIG. 3) so that the mask will be pressed against the wearer's face, wherewith the wearer's chin will forcibly abut the flap 61. Because the material in the intermediate wall 34 and also in the flap 61 is a resilient material, typically a polymeric material, the wearer's chin will lie fully against the flap 61. FIG. 5 illustrates schematically the wearer's chin in the mask prior to the straps being tightened, so that the wearer's chin can be seen.

Similar to known masks, a breathing gas is delivered to the full breathing mask of the present disclosure during use at a pressure of about 25 mm water column. Thus, as the wearer inhales, the breathing gas is caused to flow into the outer face mask 31 through the opening 46 and into the inner face mask 41 and from there into the airways of the wearer. In the following exhalation phase, the exhalation gas, which contains carbon dioxide produced in the wearer's lungs at a concentration on the order of 5%, is pressed into the inner face mask 41 and from there out to the surrounding atmosphere through the opening 46. When the next breath is taken, the exhalation gas present in the inner face mask 41 will be breathed in before fresh breathing gas reaches the upper airways of the wearer.

In the case of the full breathing mask of the present disclosure, the upper part of the perimeter 42 of the inner face mask 41 according to the forms of the disclosure provided herein and the flap 61 embrace the wearer's mouth and nose parts. The material from which the inner face mask 41 is made has a stiffness such that when the full breathing mask is donned and the straps 32 are tightened, the pressure exerted on the perimeter of the inner face mask 41 together with the pressure exerted by the intermediate wall 34 and flap 61 results in a face-sealing effect. This prevents leakage from the inner face mask 41 to the outer face mask 31 during exhalation.

What is claimed is:

1. A method of reducing an inhaled concentration of carbon dioxide when using a full breathing mask placed on the face of a wearer, wherein the full breathing mask includes an inner face mask and an outer face mask, the method comprising:

delivering breathing gas first to the outer face mask and then to the inner mask;

directing exhalation gas to flow through the inner face mask prior to being released from the full breathing mask; and impeding leakage of the exhalation gas from the inner face mask to the outer face mask during an exhalation phase, by causing the entire perimeter of the inner face mask to lie in direct sealing abutment with the face of the wearer by bringing a free end of an intermediate wall into abutment with the inner face mask, wherein the intermediate wall extends from an inside of the outer face mask and a lower part of the inner face mask extends from a convex side of the intermediate wall to a concave side of the intermediate wall.

2. The method according to claim 1, further comprising:

sealing the perimeter of the outer face mask into abutment with the wearer's face.

3. The method according to claim 2, wherein impeding leakage of the exhalation gas further includes:

blocking leakage with the aid of a rearwardly bent flap on the inner face mask, wherein the flap and the inner face mask define a channel, in which the free end of the intermediate wall is disposed.

4. The method according to claim 3, wherein impeding leakage of the exhalation gas further includes:

causing the flap to exert pressure on a concave side of the intermediate wall when the full breathing mask is donned.

5. A full breathing mask comprising:

an outer face mask, wherein the outer face mask includes a bowl-like intermediate wall extending from an inside of the outer face mask, the intermediate wall including an inner free end, a concave side, and a convex side facing away from the concave side, the concave side being adapted to face the wearer's chin when the full breathing mask is donned, an inner face mask having a perimeter and a lower part in abutment with the convex side of the intermediate wall, said lower part of the inner face mask extending from the convex side of the intermediate wall, and to the concave side of the intermediate wall such that the lower part is adapted to lie in direct sealing abutment the wearer's face when the full breathing mask is donned.

6. The full breathing mask according to claim 5, wherein the free end of the intermediate wall is spaced from the wearer's face.

7. The full breathing mask according to claim 5, wherein the inner face mask includes a flap which defines a channel with the inner face mask such that the free end of the intermediate wall is disposed in said channel.

8. The full breathing mask according to claim 7, wherein the flap is biased into abutment with the intermediate wall.

9. The full breathing mask according to claim 7, wherein the flap and the inner face mask comprise a one-piece structure.

10. The full breathing mask of claim 5, wherein the lower part of the inner face mask is formed as a flap being in abutment with the convex side of the intermediate wall and bent back around the free end of the intermediate wall.

11. The full breathing mask of claim 5, wherein the lower part of the inner mask is in abutment with and extends along the convex side of the intermediate wall.

* * * * *

UNITED STATES PATENT AND TRADEMARK OFFICE

CERTIFICATE OF CORRECTION

PATENT NO. : 7,814,909 B2
APPLICATION NO. : 11/402496
DATED : October 19, 2010
INVENTOR(S) : Olof Rylander It is certified that error appears in the above-identified patent and that said Letters Patent is hereby corrected as shown below:

On the Title Page:

At item (30), "0500826" should be -- 0500826-3 --.

In the Claims:

At Column 8, line 10, "abutment the" should be -- abutment with the --.

Signed and Sealed this
Fifth Day of July, 2011

David J. Kappos

David J. Kappos
*Director of the United States Patent and Trademark Office*